US007128455B2

(12) United States Patent
Yamamura

(10) Patent No.: US 7,128,455 B2
(45) Date of Patent: Oct. 31, 2006

(54) VEHICULAR HEADLAMP

(75) Inventor: Satoshi Yamamura, Shizuoka (JP)

(73) Assignee: Koito Manufacturing Co. Ltd., Tokyo (JP)

( * ) Notice: Subject to any disclaimer, the term of this patent is extended or adjusted under 35 U.S.C. 154(b) by 95 days.

(21) Appl. No.: 11/043,699

(22) Filed: Jan. 27, 2005

(65) Prior Publication Data

US 2005/0162859 A1 Jul. 28, 2005

(30) Foreign Application Priority Data

Jan. 27, 2004 (JP) ..... P.2004-018427

(51) Int. Cl.
*F21V 11/00* (2006.01)

(52) U.S. Cl. ..... 362/539; 362/538; 362/507; 362/509; 362/514

(58) Field of Classification Search ..... 362/539, 362/507, 509, 514, 516, 538, 238, 247; 313/113
See application file for complete search history.

(56) References Cited

U.S. PATENT DOCUMENTS 4,677,532 A * 6/1987 Peitz et al. ..... 362/539
2001/0021112 A1 9/2001 Taniuchi et al.
2001/0040810 A1* 11/2001 Kusagaya ..... 362/351

FOREIGN PATENT DOCUMENTS

JP 2-47704 U 4/1990
JP 2001-229751 A 8/2001

* cited by examiner

*Primary Examiner*—Sandra O'Shea
*Assistant Examiner*—Mark Tsidulko
(74) *Attorney, Agent, or Firm*—Sughrue Mion, PLLC

(57) ABSTRACT

A vehicular headlamp having a light source bulb inserted into a reflector from a side of an optical axis Ax at a position below the optical axis enables an area to the side of the optical axis of the reflective surface of the reflector to be utilized effectively for light distribution control. The shape of the reflective surface of the reflector in a vertical cross section that includes the optical axis Ax is defined by a curve, which is formed such that a normal line of each point of the reflective surface is positioned between a bisector of a line segment that joins each point with a light source and a line segment that joins each point with an upper end edge of a shade, and a bisector of the line segment and a line segment that joins each point with an upper end edge of a rear surface opening of a projection lens.

6 Claims, 5 Drawing Sheets

VEHICULAR HEADLAMP

BACKGROUND OF THE INVENTION

1. Field of the Invention

The present invention relates to a vehicular headlamp structured to radiate light to form a low-beam distribution pattern. In particular, the present invention relates to a projector-type vehicular headlamp.

2. Description of the Related Art

Generally, a projection-type vehicular headlamp is structured such that a projection lens is disposed on an optical axis that extends in a vehicular longitudinal direction, a light source is disposed at a rear side of a rear side focal point of the projection lens, and light from the light source is reflected toward the optical axis by a reflector.

In addition, Unexamined Japanese Utility Model Application Publication No. Hei. 2-47704 ("Patent Document 1") and Unexamined Japanese Patent Application Publication No. 2001-229715 ("Patent Document 2") describe a side-insertion-type lamp configuration in which, in a projection-type vehicular headlamp with the structure described above, the light source is constituted by the light-emitting portion of a light source bulb that is fixedly mounted on the reflector from a side of the optical axis.

Moreover, the vehicular headlamp described in Patent Document 2 is structured such that a shade that blocks a portion of the light reflected from the reflector is provided in the proximity of the rear side focal point of the projection lens, thereby enabling radiation of light in order to form a low-beam distribution pattern.

If a side-insertion-type lamp configuration as described in either of the Patent Documents above is used, the longitudinal size of the lamp is reduced, thereby enabling the lamp to be made more compact.

However, the vehicular headlamps described in Patent Documents 1 and 2 have the following problems, which arise due to the fact that a light source bulb is fixedly mounted on a reflector with the light-emitting portion of the bulb lying in the same horizontal plane as that containing the optical axis of the lamp.

Specifically, although an area of the reflective surface of the reflector to the side of the optical axis is suitable for forming a diffusion region of a low-beam distribution pattern, if the light source bulb is fixedly mounted on the reflector in the same horizontal plane as the optical axis, the area to the side of the optical axis cannot be utilized effectively for light distribution control because a hole for inserting the light source bulb must be formed in the area to the side of the optical axis of the reflective surface, which makes it difficult to secure sufficient brightness for the diffusion region of the low-beam distribution pattern.

Furthermore, if the light source is structured as a line segment light source that extends in a bulb central axis direction, the luminous flux utilization factor with respect to light emitted from the light source is reduced in comparison with that which can be obtained from a line segment light source that extends in an optical axis direction, and the low-beam distribution pattern is darkened by a corresponding amount.

SUMMARY OF THE INVENTION

The present invention has been made in view of the foregoing problems. It is an object of the present invention to provide a vehicular headlamp capable of securing sufficient brightness for the low-beam distribution pattern in the projection-type vehicular headlamp structured to form a low-beam distribution pattern even if a side-insertion-type lamp configuration is employed.

The present invention achieves the above and other objects by determining the position at which a light source bulb is inserted and fixedly mounted on a reflector, and by suitably devising a shape of a reflective surface of the reflector.

More specifically, the vehicular headlamp according to the present invention is structured to radiate light to form a low-beam distribution pattern, the vehicular headlamp comprising: a projection lens disposed on an optical axis that extends in a vehicular longitudinal direction, a light source on a rear side of a rear side focal point of the projection lens, a reflector that reflects light from the light source in a forward direction toward the optical axis, and a shade that blocks a portion of the light reflected from the reflector and is disposed in the proximity of the rear side focal point, such that an upper end edge of the shade is positioned in the proximity of the optical axis. The light source is structured as a line segment light source that extends in a bulb central axis direction by a light source bulb which has a light-emitting portion and is fixedly mounted on the reflector from a side of the optical axis at a position below the optical axis, and the shape of the reflective surface of the reflector in a vertical cross section that includes the optical axis is defined by a curve which is formed such that a normal line of each point of the reflective surface is positioned between a bisector of a line segment that joins each of the points with the light source and a line segment that joins each of the points with the upper end edge of the shade, and a bisector of a line segment that joins each of the points with the light source and a line segment that joins each of the points with an upper end edge of a rear surface opening of the projection lens.

The type of the above light source bulb is not particularly limited and, for example, a discharge bulb or a halogen bulb may be employed.

The light source bulb is described above as being fixedly mounted on the reflector at a position below the optical axis, but the amount of downward displacement from the optical axis of the fixing insertion position is not particularly limited. More specifically, from the standpoint of preventing light from the light source bulb that is reflected in the area in the proximity of the optical axis on the reflective surface of the reflector from being blocked by the light source bulb, it is preferable that a value of 10 mm or more be set for the amount of downward displacement, and it is even more preferable that a value of 15 mm or more be set. On the other hand, from the standpoint of securing a sufficient incident light flux to the reflective surface of the reflector from the light source bulb, it is preferable that the amount of downward displacement be set to a value of 30 mm or less.

Provided that the reflective surface of the reflector described above is structured such that light from the light source is reflected in a forward direction toward the optical axis and its shape in the vertical cross section that includes the optical axis is defined by the above-mentioned curve, there is no particular limitation with regard to the specific surface shape thereof. For example, provided that the normal lines are positioned between the two bisectors, there is no particular limitation with regard to the specific orientation thereof.

As indicated in the structure described above, the vehicular headlamp according to the present invention is configured as a projection-type vehicular headlamp and, because a light source bulb thereof is fixedly mounted on a reflector while being inserted from a side of an optical axis that extends in a vehicular longitudinal direction, the longitudinal size of the lamp is shortened, thereby enabling the lamp to be made more compact.

In addition, since the light source bulb is fixedly mounted at a position below the optical axis, an area to the side of the optical axis of a reflective surface of the reflector can be utilized effectively for light distribution control. Moreover, a diffusion region of a low-beam distribution pattern is formed by light reflected from the area to the side of the optical axis, enabling sufficient brightness to be secured in the diffusion region.

Furthermore, since the shape of the reflective surface of the reflector in a vertical cross section that includes the optical axis is defined by a curve which is formed such that a normal line of each point of the reflective surface is positioned between (a) a bisector of a line segment that joins each of the points with the light source and a line segment that joins each of the points with an upper end edge of a shade and (b) a bisector of a line segment that joins each of the points with the light source and a line segment that joins each of the points with an upper end edge of a rear surface opening of a projection lens (hereinafter referred to as the "first curve"), the effects as described below can be obtained.

Although a distinct cut-off line can be formed on an upper end edge of the low-beam distribution pattern by using the shade to block a portion of the light from the light source that is reflected by the reflector, it is preferable to increase the luminous flux utilization factor with respect to the light emitted from the light source by reducing the amount of light blocked by the shade to a required minimum so as to provide a low-beam distribution pattern which is as bright as possible.

With regard to this point, according to the present invention, since the shape of the reflective surface of the reflector in the vertical cross section that includes the optical axis is defined by the first curve, the light from the light source that is reflected in an area in the proximity of the vertical cross section can be emitted to the projection lens, passing above the upper end edge of the shade, thus enabling the amount of light blocked by the shade to be reduced and increasing the brightness of the low-beam distribution pattern.

More specifically, when the light source is structured as a line segment light source that extends in the bulb central axis direction, as in the case of the vehicular headlamp according to the present invention, the luminous flux utilization factor with respect to the light emitted from the light source can be increased substantially by reducing the amount of light reflected from the area in the proximity of the vertical cross section including the optical axis, that is, light blocked by the shade, because the light ray bundle with the highest luminous intensity, which is oriented from the light source in a direction orthogonal to the bulb central axis, is emitted to the area in the proximity of the vertical cross section including the optical axis. This enables the low-beam distribution pattern to be sufficiently bright.

In this way, the projection-type vehicular headlamp that is structured to form the low-beam distribution pattern according to the present invention is able to secure sufficient brightness for the low-beam distribution pattern even when a side-insertion-type lamp configuration is employed.

In addition, although there is no particular limitation with regard to the shape of the reflective surface of the reflector in a vertical cross section other than the vertical cross section that includes the optical axis, it is possible to reduce the amount of light that is blocked by the shade even for light that is reflected from an area other than the area in the proximity of the vertical cross section that includes the optical axis, even for a shape of the reflective surface in a vertical cross section that is parallel to the vertical cross section that includes the optical axis, provided that the shape is defined by a curve identical to the first curve. This enables the luminous flux utilization factor with respect to the light emitted from the light source to be increased.

Since, in the structure described above, the shape of the reflective surface of the reflector in the vertical cross section that includes the optical axis is defined by a curve which is formed such that the normal line of each point of the reflective surface is positioned between (a) the bisector of the line segment that joins each of the points with the light source and the line segment that joins each of the points with the upper end edge of the shade and (b) the bisector of the line segment that joins each of the points with the light source and a line segment that joins each of the points with a point on the optical axis of a rear surface of the projection lens (hereinafter referred to as the "second curve"), the effects as described below can be obtained.

Since the shape of an upper reflection area in the vertical cross section that includes the optical axis is defined by the second curve, the light from the light source that is reflected in the area in the proximity of the vertical cross section can be emitted to the projection lens below the optical axis. As a result, although the reflected light passes above the upper end edge of the shade, it is possible to make it pass through a position that is not substantially separated from the upper end edge. By reducing the amount of light blocked by the shade in this way, the upper and lower widths of the low-beam distribution pattern can be prevented from becoming too large. Moreover, this also prevents a reduction in visibility in an area further away from the vehicle due to an area of a road surface closer to the head of the vehicle becoming too bright.

In the structure described above, the material of the projection lens is not particularly limited, but if the projection lens is constituted by a synthetic resin lens a reduction in weight and cost can be achieved for the projection lens in comparison with the one constituted by a glass lens.

Note that thermal deformation of the projection lens may be prevented easily, even if the projection lens is constituted by synthetic resin, for the reasons described below.

That is, according to the present invention, since the light source is disposed below the optical axis and, furthermore, since the shade is disposed in the proximity of the rear side focal point of the projection lens such that the upper end edge thereof is positioned in the proximity of the optical axis, the light directly emitted from the light source can be emitted so that little will strike the projection lens, thereby enabling an increase in temperature of the projection lens caused by radiant heat from the light source to be suppressed in an effective manner.

Moreover, according to the present invention, since the light source is structured as a line segment light source that extends in the bulb central axis direction, it is simple to stagger the positions at which the light reflected from each point of the reflective surface of the reflector in the vertical cross section that includes the optical axis strikes the projection lens, mutually in an upward or downward direction such that overlap does not occur, thereby preventing a local increase in temperature of the projection lens.

Therefore, according to the present invention, thermal deformation of the projection lens can be prevented easily, even if the projection lens is constituted by a synthetic resin lens.

BRIEF DESCRIPTION OF THE DRAWINGS

Hereinafter, preferred embodiments of the present invention will be described with reference to the drawings.

DETAILED DESCRIPTION OF THE PREFERRED EMBODIMENTS

Figure 1:
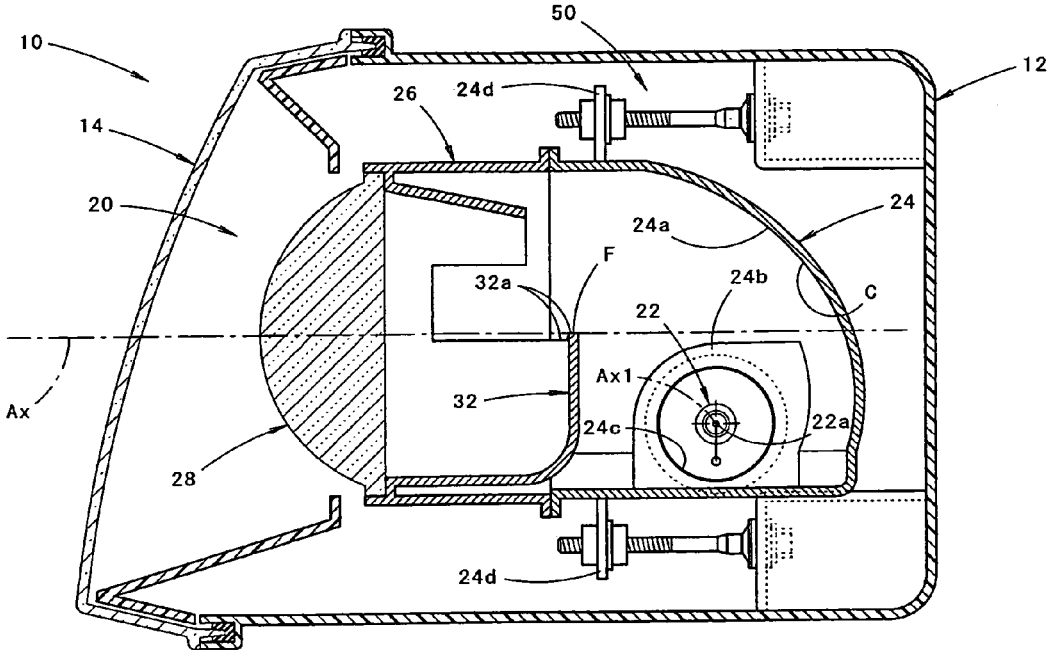
FIG. 1 is lateral cross-sectional view showing a vehicular headlamp according to an embodiment of the present invention.

FIG. 1 is a lateral cross-sectional view showing a vehicular headlamp according to an embodiment of the present invention. As shown in the figure, a vehicular headlamp 10 in the embodiment is structured such that a lamp unit 20, which has an optical axis Ax that extends in a vehicular longitudinal direction, is inside a lamp chamber that is formed by a lamp body 12 and a generally plain translucent cover 14 that is attached to a front end opening portion of the lamp body 12, is tiltable in vertical and lateral directions through an aiming mechanism 50.

In addition, at a stage when aiming adjustment as performed by the aiming mechanism 50 is completed, the optical axis Ax of the lamp unit 20 is set so as to extend in a downward-oriented direction by approximately 0.5 to 0.6° with respect to the vehicular longitudinal direction.

Figure 2:
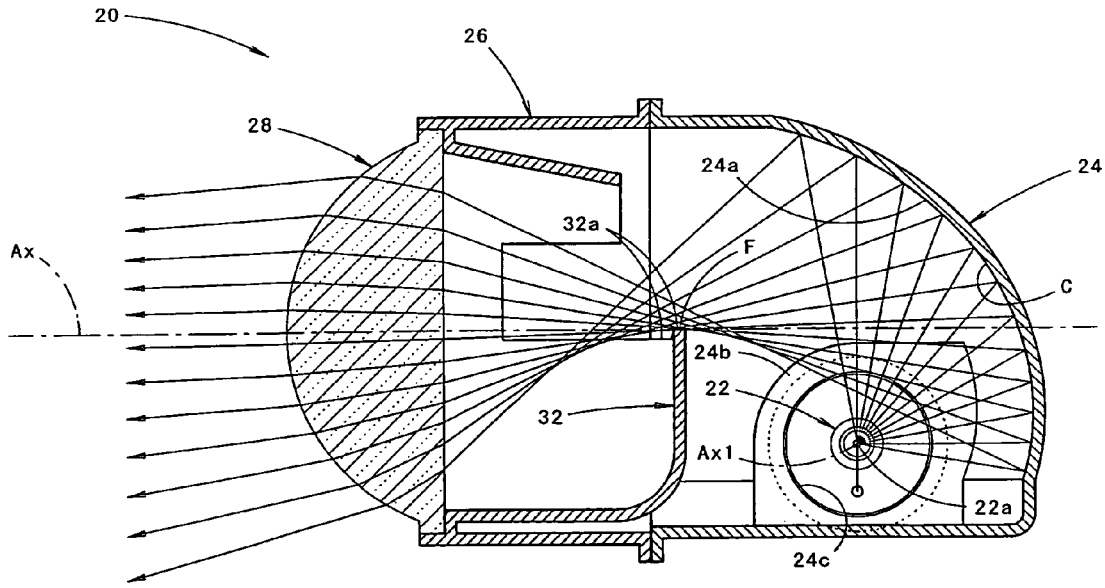
FIG. 2 is a lateral cross-sectional view showing a single lamp unit of the vehicular headlamp.
Figure 3:
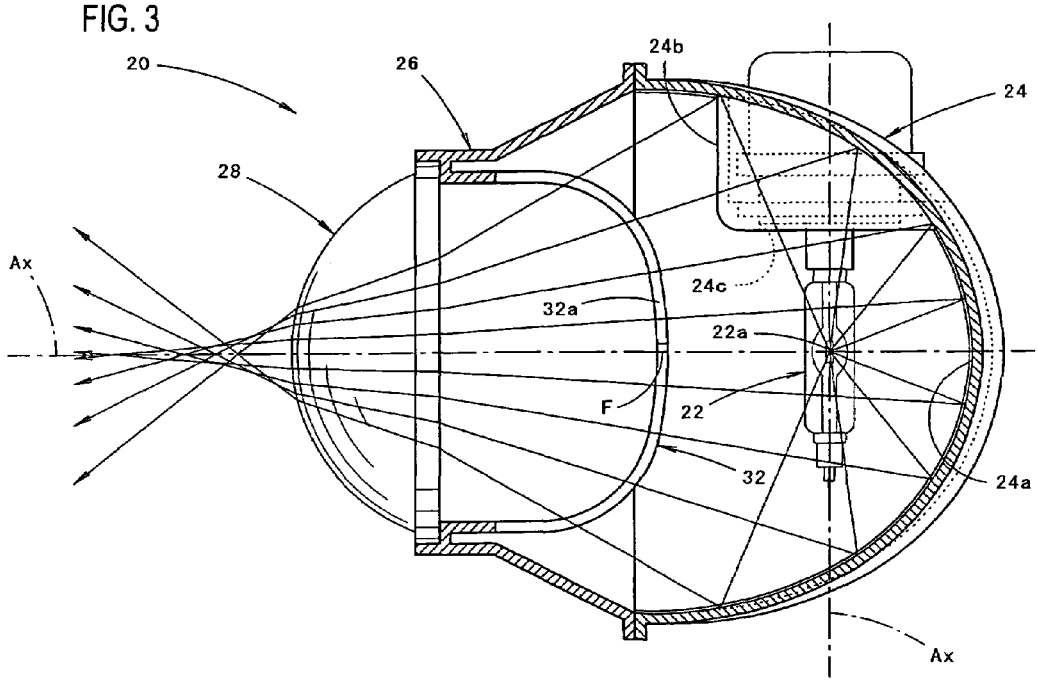
FIG. 3 is a plane cross-sectional view showing a single unit of the lamp unit.

FIGS. 2 and 3 are a lateral cross-sectional view and a plane cross-sectional view showing a single unit of the lamp unit 20.

As shown in these figures, the lamp unit 20 is a projection-type lamp unit and includes a light source bulb 22, a reflector 24, a holder 26, a projection lens 28 and a shade 32.

The projection lens 28, which is disposed on the optical axis Ax, is formed by a planoconvex lens whose front side surface is a convex surface and rear side surface is planar. In addition, the projection lens 28 is configured to project an image on a focal plane, which includes a rear side focal point F thereof in a forward direction as an inverted image. The projection lens 28 is constituted by a synthetic resin lens made of acrylic resin, polycarbonate resin or the like.

A light source bulb 22 is a discharge bulb such as a metal halide bulb or the like, with a discharging light source used as a light source 22*a*. The light source 22*a* is structured as a line segment light source that extends in the direction of a bulb central axis Ax1. In addition, the light source bulb 22 is fixedly mounted on the reflector 24 from the right side of the optical axis Ax on the rear side of the rear side focal point F of the projection lens 28 and below the optical axis Ax (for example, approximately 20 mm below the optical axis Ax). The light source bulb 22 is fixedly mounted such that the light emission center of the light source 22*a* is positioned vertically below the optical axis Ax in a state such that the bulb central axis Ax1 extends in the horizontal direction and lies in a vertical plane that is orthogonal to the optical axis Ax.

The reflector 24 has a reflective surface 24*a* that reflects light from the light source bulb 22 in the forward direction toward the optical axis Ax. The reflective surface 24*a* has a cross-section that is generally ellipsoidal in shape and an eccentricity that becomes gradually larger from a vertical cross section toward a horizontal cross section. Consequently, the light from the light source 22*a* reflected by the reflective surface 24*a* is substantially converged in the proximity of the rear side focal point F in the vertical cross section, and hence the convergence position of the reflected light in the horizontal cross section is moved substantially forward. Note that the specific surface shape of the reflective surface 24*a* is described below.

A bulb insertion fixing portion 24*b* is formed in a lower right side area of the reflective surface 24*a* of the reflector 24 so as to protrude from the reflective surface 24*a*, and a bulb insertion hole 24*c* is formed in a left side surface portion of the bulb insertion fixing portion 24*b*. In addition, the reflector 24 is supported by the lamp body 12 through the aiming mechanism 50 on aiming brackets 24*d* fixed at three locations of the reflector 24.

The holder 26 extends in a generally cylindrical shape forward from a front end opening portion of the reflector 24, and a rear end portion of the holder 26 is fixedly supported by the reflector 24 and a front end portion of the holder 26 fixedly supports the projection lens 28.

The shade 32 is integrally formed with the holder 26 so as to be positioned substantially in a lower half of the internal space of the holder 26. The shade 32 is formed such that an upper end edge 32*a* thereof passes through the rear side focal point F of the projection lens 28, thereby blocking a portion of the light reflected from the reflective surface 24*a* of the reflector 24 and removing much of the upward-oriented light directed toward the projection lens 28. In addition, the upper end edge 32*a* of the shade 32 extends in a generally circular shape in the horizontal direction along the rear side focal plane of the projection lens 28, and is formed in a stepped fashion to the left and the right.

Figure 4:
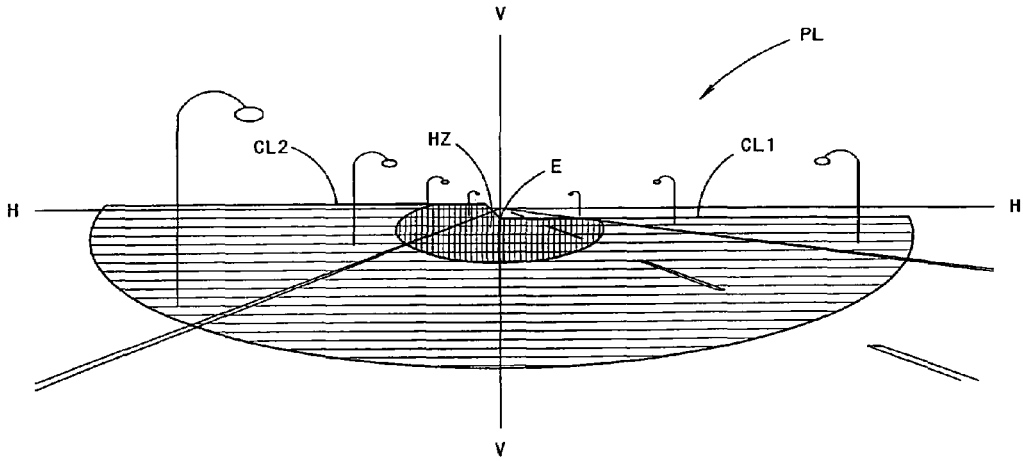
FIG. 4 is a diagram that shows in a transparent manner a distribution pattern formed on an imaginary vertical screen provided in a position 25 m to the front of the lamp by light emitted in a forward direction from the vehicular headlamp.

FIG. 4 is a diagram that shows a low-beam distribution pattern formed on an imaginary vertical screen provided in a position 25 m from the front of the lamp by light emitted in a forward direction from the vehicular headlamp 10.

As shown in the figure, a low-beam distribution pattern PL is a low-beam distribution pattern for left side light distribution that has cut-off lines CL1 and CL2 on an upper end edge in a stepped fashion between the left and the right. The cut-off lines CL1 and CL2 extend horizontally in a stepped fashion between the left and the right, divided by a line V—V that passes in a vertical direction through a vanishing point H–V, which is in a forward direction of a lamp. An oncoming vehicle lane side portion to the right side of the line V—V is formed as the lower step cut-off line CL1, and a same-lane side portion to the left side of the line V—V is formed as the upper step cut-off line CL2, which is a step raised from the lower step cut-off line CL1 through an inclined portion. In the low-beam distribution pattern PL, an elbow point E, which is an intersection point between the lower step cut-off line CL1 and the line V—V, is at a position approximately 0.5 to 0.6° below the line H–V, and a hot zone HZ, which is an area of high-intensity light, is formed to surround the elbow point E.

The low-beam distribution pattern PL is formed by projecting an image of the light source 22*a*, which is formed on the rear side focal plane of the projection lens 28 by reflecting the light from the light source 22*a* with the reflective surface 24*a* of the reflector 24 as an inverted projection image, on the aforementioned imaginary vertical screen by the projection lens 28. The cut-off lines CL1 and CL2 are formed as an inverted projection image of the upper end edge 32*a* of the shade 32.

Figure 5:
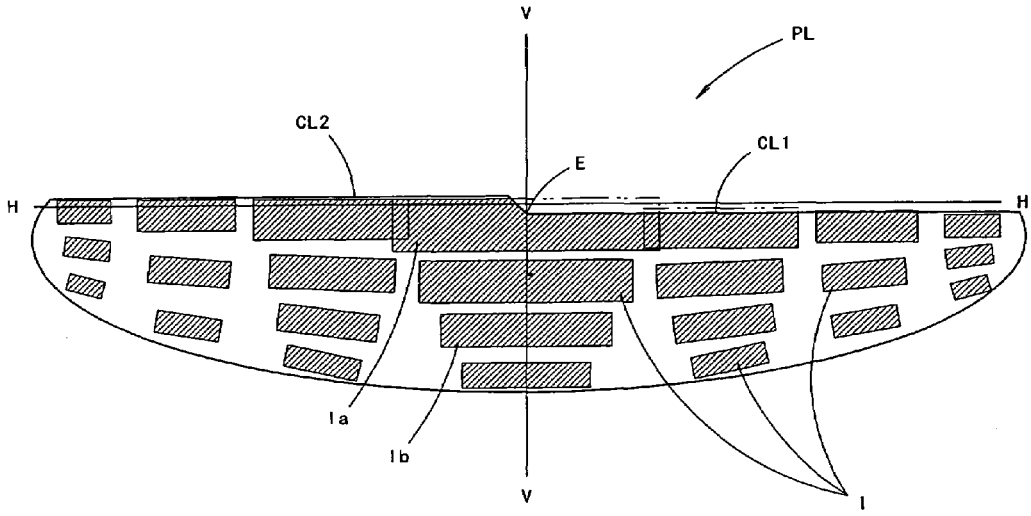
FIG. 5 is a diagram that shows inverted projection images of the light source, which make up the low-beam distribution pattern.

FIG. 5 is a diagram that shows inverted projection images I of the light source 22*a*, which images make up the low-beam distribution pattern PL.

As shown in the figure, each inverted projection image I is formed as a generally horizontally oblong-shaped image because the light source 22*a* is disposed to extend in a horizontal direction in a vertical plane orthogonal to the optical axis Ax. In addition, of the inverted projection images I, an inverted projection image formed in a position close to the elbow point E is formed as a comparatively large image since it is formed by light from the light source 22*a* that is reflected at a point on the reflective surface 24*a* of the reflector 24 comparatively close to the light source 22*a*. On the other hand, an inverted projection image formed in a position farther from the elbow point E is formed as a comparatively small image, since it is formed by light reflected at a point on the reflective surface 24*a* of the reflector 24 comparatively far from the light source 22*a*.

Figure 6:
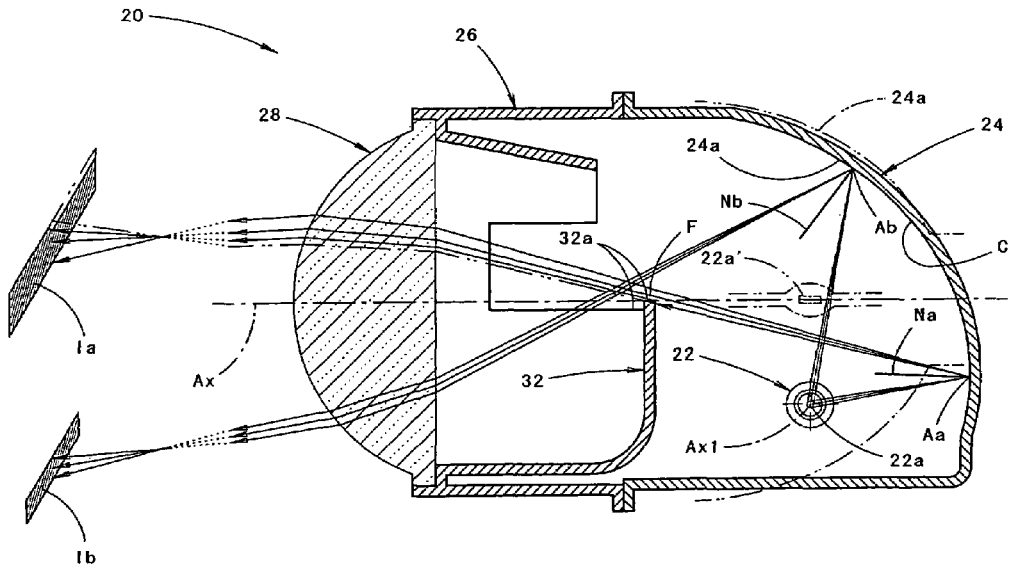
FIG. 6 is a diagram that shows, of the light reflected from the light source by the reflective surface of the reflector, optical paths of light reflected from two points in a vertical cross section that includes the optical axis, as well as two inverted projection images formed by this reflected light.

FIG. 6 is a diagram that shows, of the light from the light source 22*a* and reflected by the reflective surface 24*a* of the reflector 24, optical paths of light reflected from two points Aa and Ab in a vertical cross section that includes the optical axis Ax, as well as two inverted projection images Ia and Ib formed by this reflected light.

As shown in the figure, the light that is reflected at the point Aa, which is positioned on the reflective surface 24*a* of the reflector 24 and slightly below the optical axis Ax, proceeds toward the projection lens 28, passing in close proximity above the upper end edge 32*a* of the shade 32, thereby forming the inverted projection image Ia that is positioned in the proximity of the elbow point E (see FIG. 5).

The visual angle from the light source 22*a* with respect to the point Aa becomes a comparatively large value because the point Aa is in a position comparatively close to the light source 22*a*, and consequently the inverted projection image Ia becomes a comparatively large image. Furthermore, because a portion of the light reflected from the point Aa is blocked by the shade 32, an upper portion of the generally horizontally oblong image of the inverted projection image Ia is removed in accordance with the shape of the upper end edge 32*a* of the shade 32.

On the other hand, the light that is reflected at the point Ab, which is on the reflective surface 24*a* of the reflector 24 and above the optical axis Ax, proceeds toward the projection lens 28, passing the upper end edge 32*a* of the shade 32 above the light reflected from the point Aa, thereby forming the inverted projection image Ib that is positioned below the elbow point E (see FIG. 5).

Accordingly, the visual angle from the light source 22*a* with respect to the point Ab becomes a comparatively small value because the point Ab is in a position comparatively far from the light source 22*a*, and consequently the inverted projection image Ib becomes a comparatively small image. Furthermore, because the light reflected from the point Ab is not blocked by the shade 32, the shape of the inverted projection image Ib remains generally horizontally oblong.

Figure 7:
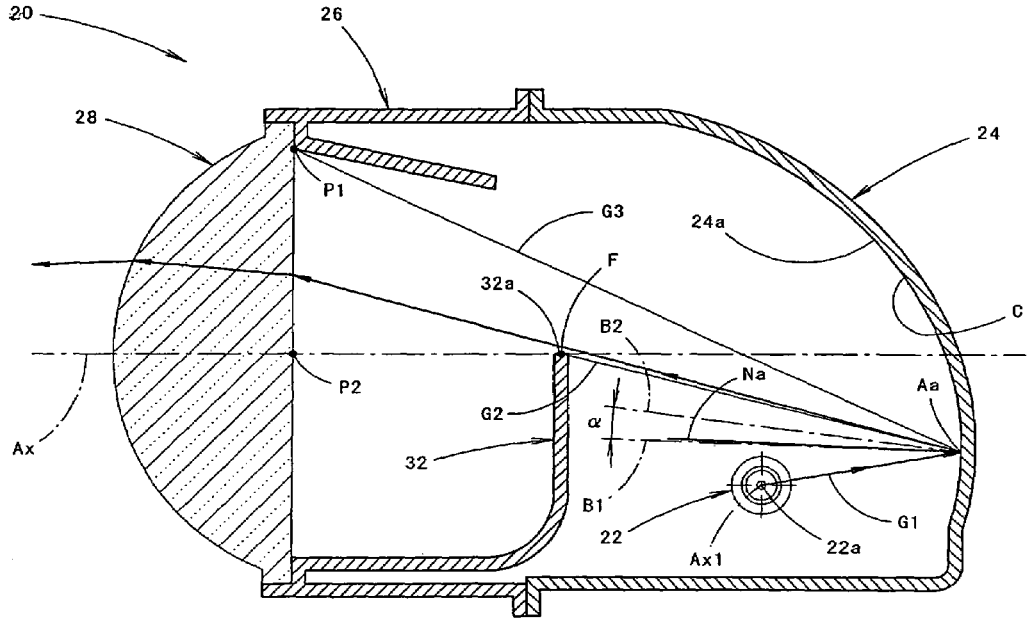
FIG. 7 is a diagram that describes a shape of the reflective surface of the reflector.
Figure 8:
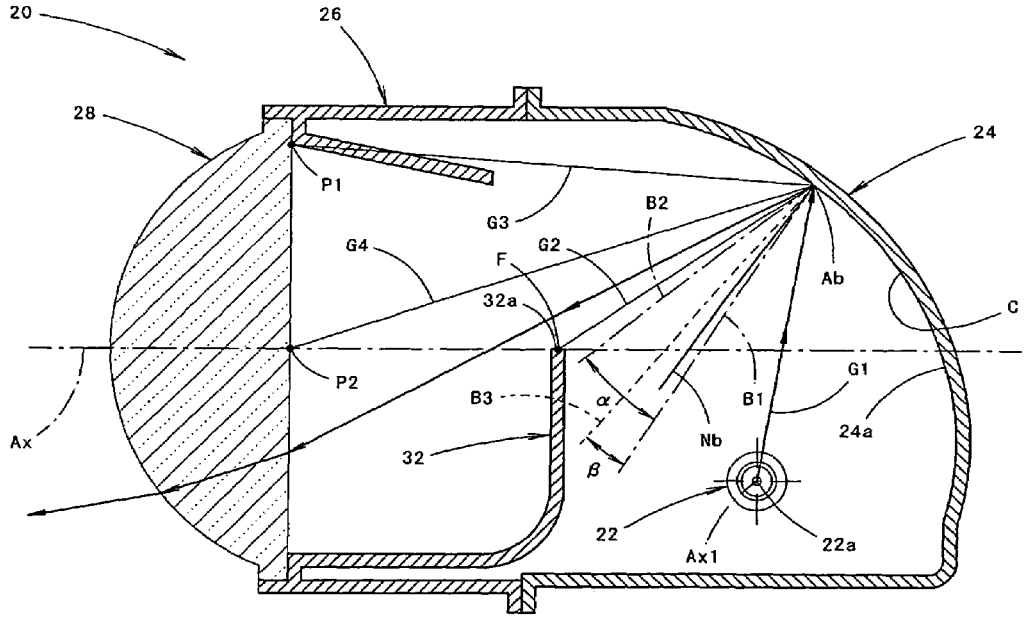
FIG. 8 is another diagram that describes a shape of the reflective surface of the reflector.

As shown in FIGS. 7 and 8, a curve C, which is defined by the shape of the reflective surface 24*a* of the reflector 24 in the vertical cross section that includes the optical axis Ax, is formed such that normal lines Na and Nb of each of the points Aa and Ab of the reflective surface 24*a* are positioned between two bisectors B1 and B2 (that is, within the range shown by the angle ▯). In more detail, the bisector B1 is a bisector of a line segment G1 that joins each of the points Aa and Ab with the light source 22*a* (more precisely, a point on the bulb central axis Ax1 that is the center of light emission of the light source 22*a*) and a line segment G2 that joins each of the points Aa and Ab with the upper end edge 32*a* of the shade 32 (that is, the rear side focal point F of the projection lens 28), and the bisector B2 is a bisector of the line segment G1 and a line segment G3 that joins each of the points Aa and Ab with an upper end edge P1 of a rear surface opening of the projection lens 28.

Consequently, as shown in FIG. 2, the light reflected from the reflective surface 24*a* of the reflector 24 proceeds toward the projection lens 28, so as to pass above the upper end edge 32*a* of the shade 32, thereby reducing the amount of light blocked by the shade 32 to a minimum level.

In addition, as shown in FIG. 8, in an upper reflection area on the reflective surface 24*a* of the reflector 24, above the optical axis Ax, the curve C is formed such that the normal line Nb of each point Ab of the reflective surface 24*a* is positioned between two bisectors B1 and B3 (that is, within the range shown by the angle ▯) since the angle ▯is a fairly large value. In more detail, the bisector B3 is a bisector of the line segment G1 and a line segment G4 that joins each point Ab with a point P2 on the optical axis Ax of a rear surface of the projection lens 28.

Consequently, the light reflected from the upper reflection area of the reflective surface 24*a* passes above the upper end edge 32*a* of the shade 32 and the passing position is not substantially separated from the upper end edge 32*a*.

According to this embodiment, not only the shape of the reflective surface 24*a* in the vertical cross section that includes the optical axis Ax, but also the shape of the reflective surface 24*a* in a vertical cross section parallel to this vertical cross section, is defined by a curve that is identical to the curve C.

As described above, the vehicular headlamp 10 according to the preferred embodiment is configured as a projection-type vehicular headlamp that radiates light in a pattern appropriate to form the low-beam distribution pattern PL. Because the light source bulb 22 is fixedly mounted on the reflector 24 from a side of the optical axis Ax that extends in the vehicular longitudinal direction, the longitudinal length of the lamp is reduced, thereby making the lamp more compact.

In addition, since the light source bulb 22 is fixedly mounted at a position below the optical axis Ax, an area to the side of the optical axis of the reflective surface 24*a* of the reflector 24 can be utilized effectively for light distribution control. Moreover, a diffusion region of the low-beam distribution pattern PL is formed by light reflected from the area to the side of the optical axis, enabling sufficient brightness to be secured in the diffusion region.

Furthermore, since the shape of the reflective surface 24*a* of the reflector 24 in the vertical cross section that includes the optical axis Ax is defined by the curve C, which is formed such that the normal lines Na and Nb of each of the points Aa and Ab of the reflective surface 24*a* are positioned between (a) the bisector B1 of the line segment G1 that joins each of the points Aa and Ab with the light source 22*a* and the line segment G2 that joins each of the points Aa and Ab with the upper end edge 32*a* of the shade 32 and (b) the bisector B2 of the line segment G1 and the line segment G3 that joins each of the points Aa and Ab with the upper end edge P1 of the rear surface opening of the projection lens 28, the effects as described below can be obtained.

In other words, according to the above-described embodiment, although distinct cut-off lines CL1 and CL2 are formed on the upper end edge of the low-beam distribution pattern PL by using the shade 32 to block a portion of the light reflected by the reflector 24 from the light source 22*a*, it is preferable to increase the luminous flux utilization factor of the light emitted from the light source 22*a* by reducing the amount of light blocked by the shade 32 to the minimum in order to provide a low-beam distribution pattern PL as bright as possible.

With regard to this point, since the shape of the reflective surface 24*a* of the reflector 24 in the vertical cross section that includes the optical axis Ax is defined by the curve C, the light from the light source 22*a* that is reflected in an area in the proximity of the vertical cross section can be emitted to the projection lens 28, passing above the upper end edge 32*a* of the shade 32, thus enabling the amount of light blocked by the shade 32 to be reduced and increasing the brightness of the low-beam distribution pattern PL.

More specifically, when the light source 22*a* is structured as a line segment light source that extends in the direction of the bulb central axis Ax1, as in the case of the vehicular headlamp 10 according to the preferred embodiments, the luminous flux utilization factor with respect to the light emitted from the light source 22*a* can be increased substantially by reducing the amount of light reflected from the area in the proximity of the vertical cross section and blocked by the shade because the light ray bundle with the highest luminous intensity, which is oriented from the light source 22*a* in a direction orthogonal to the bulb central axis Ax1, is emitted to the area in the proximity of the vertical cross section that includes the optical axis Ax. This enables the low-beam distribution pattern PL to be sufficiently bright.

In this way the projection-type vehicular headlamp that is structured to form the low-beam distribution pattern PL according to the preferred embodiments is able to provide sufficient brightness for the low-beam distribution pattern PL, even when a side-insertion-type lamp configuration is employed.

In addition, it is possible to reduce the amount of light blocked by the shade 23 even for light that is reflected from an area other than the area in the proximity of the vertical cross section that includes the optical axis Ax, not only for the portion of the reflective surface 24*a* of the reflector 24 in the vertical cross section that includes the optical axis Ax, but also for the portion of the reflective surface 24*a* in the vertical cross section parallel to that vertical cross section since this shape is defined by a curve identical to the curve C. This enables the luminous flux utilization factor with respect to the light emitted from the light source 22*a* to be increased.

Hereinafter, a comparison with a conventional example will be described with regard to the effects described above.

Figure 9:
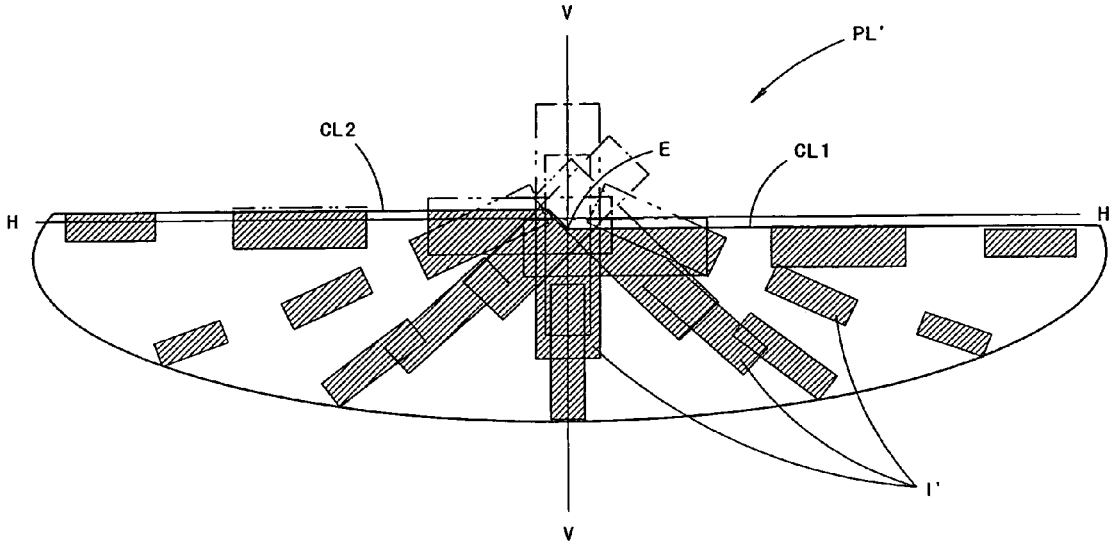
FIG. 9 is a diagram that shows the low-beam distribution pattern formed when a conventional lamp structure is employed.

FIG. 9 is a diagram that shows the low-beam distribution pattern PL that is formed when a conventional lamp structure is employed.

In more detail, a low-beam distribution pattern PL' is a distribution pattern that is formed when light from a light source 22*a'*, which is formed as a line segment light source disposed to extend along the optical axis Ax, is reflected by a reflective surface 24*a'* that comprises an ellipsoidal surface, as shown by the two-dotted broken line in FIG. 6.

Because inverted projection images I' of the light source 22*a'* that constitute the low-beam distribution pattern PL' are formed as generally rectangular images that extend in a generally radial fashion from the elbow point E, a substantial portion of each projection image I' protrudes above the cut-off lines CL1 and CL2 in the vicinity of the elbow point E. Since the light that should form these upper protruding portions is blocked by the shade 32, however, the luminous flux utilization factor with respect to the light emitted from the light source 22*a* is decreased by just that amount.

In contrast, according to the invention, it is possible to increase the luminous flux utilization factor with respect to the light emitted from the light source 22*a*, since it is possible to reduce substantially the amount of light blocked by the shade 32.

Note that in the conventional lamp structure, a surface shape of the reflective surface 24*a'* can be adjusted to displace a formation position of the inverted projection images I', which are formed to protrude from the top of the cut-off lines CL1 and CL2, in order to reduce the amount of light blocked by the shade 32. Since these inverted projection images I' are extended in a generally radial fashion, however, a large degree of light distribution unevenness is formed in an area of a road surface close to the head of the vehicle if the formation position is displaced in a downward direction.

With further regard to this point, since the inverted projection images I of the light source 22*a* that constitute the low-beam distribution pattern PL are formed as generally horizontally oblong images, no large degree of light distribution unevenness occurs in the area of the road surface close to the head of the vehicle, even if a certain amount of downward displacement of the images takes place as required.

Furthermore, because the curve C, which is defined by the shape of the reflective surface 24*a* of the reflector 24 in the vertical cross section that includes the optical axis Ax, is formed in the upper reflection area above the optical axis Ax such that the normal line Nb of each point Ab of the reflective surface 24*a* is positioned between the two bisectors B1 and B3, which is a narrower area than that between the two bisectors B1 and B2, the light from the light source 22*a* reflected in the area in the proximity of the vertical cross section can be emitted to the projection lens 28 below the optical axis Ax. As a result, although the reflected light passes above the upper end edge 32*a* of the shade 32, it is possible to make it pass through a position that is not substantially separated from the upper end edge 32*a*. Consequently, since it is possible to prevent the upper and lower widths of the low-beam distribution pattern PL from becoming too large by reducing the amount of light blocked by the shade 32, it is possible to prevent a reduction in visibility in an area further away from the vehicle due to the area of the road surface closer to the head of the vehicle becoming too bright.

Furthermore, according to the invention, because the projection lens 28 is constituted by a synthetic resin lens, a reduction in weight and cost can be achieved for the projection lens 28 in comparison to one constituted by a glass lens.

In addition, since the light source 22*a* is disposed below the optical axis Ax and, furthermore since the shade 32 is disposed at the rear side focal point F of the projection lens

28 such that the upper end edge 32*a* is positioned on the optical axis Ax, the light directly emitted from the light source 22*a* can be emitted in such a manner that little will strike the projection lens 28, thereby enabling an increase in temperature of the projection lens 28 caused by radiant heat from the light source 22*a* to be suppressed in an effective manner. Moreover, since the light source 22*a* is structured as a line segment light source that extends in the direction of the bulb central axis Ax1, it is possible to stagger the positions at which the light reflected from each of the points Aa and Ab of the reflective surface 24*a* of the reflector 24 in the vertical cross section that includes the optical axis Ax strikes the projection lens 28, mutually in an upward or downward direction such that overlap does not occur, thereby preventing a local increase in temperature of the projection lens 28. Therefore, thermal deformation of the projection lens 28 can be prevented easily, regardless of whether the projection lens 28 is constituted by a synthetic resin lens.

The light source bulb 22 has been described as being inserted from the side of the reflector 24 in a direction perpendicular to the optical axis. However, even if there is a slight deviation in the insertion angle, substantially the same effects can be achieved, provided that the amount of deviation in either the vertical direction or the longitudinal direction is approximately 30° or less.

What is claimed is:

1. A vehicular headlamp, which is structured to radiate light to form a low-beam distribution pattern, comprising: a projection lens that is disposed on an optical axis that extends in a vehicular longitudinal direction, a light source that is disposed on a rear side of a rear side focal point of the projection lens, a reflector that reflects light from the light source in a forward direction toward the optical axis, and a shade that blocks a portion of the light reflected from the reflector and is disposed in the proximity of the rear side focal point such that an upper end edge of the shade is positioned in the proximity of the optical axis, wherein:

the light source is structured as a line segment light source that extends in a bulb central axis direction, by a light source bulb which has a light-emitting portion and is fixedly mounted on the reflector from a side of the optical axis in a position below the optical axis; and a shape of a reflective surface of the reflector in a vertical cross section that includes the optical axis is defined by a curve, which is formed such that a normal line of each point of the reflective surface is positioned between a bisector of a line segment that joins each of the points with the light source and a line segment that joins each of the points with the upper end edge of the shade, and a bisector of a line segment that joins each of the points with the light source and a line segment that joins each of the points with an upper end edge of a rear surface opening of the projection lens.

2. The vehicular headlamp according to claim 1, wherein a shape of the reflective surface in the vertical cross section in an upper reflection area above the optical axis is defined by a curve, which is formed such that a normal line of each point of the reflective surface is positioned between a bisector of a line segment that joins each of the points with the light source and a line segment that joins each of the points with the upper end edge of the shade, and a bisector of a line segment that joins each of the points with the light source and a line segment that joins each of the points with a point on the optical axis of a rear surface of the projection lens.

3. The vehicular headlamp according to claim 2, wherein said projection lens is constituted by a synthetic resin lens.

4. The vehicular headlamp according to claim 1, wherein said projection lens is constituted by a synthetic resin lens.

5. The vehicular headlamp according to claim 1, wherein the light source is a discharge bulb.

6. The vehicular headlamp according to claim 1, wherein the light reflected from an reflection area of the reflective surface above the optical axis passes above the upper end edge of the shade.

* * * * *